United States Patent [19]

Kirsch

[11] 4,128,967

[45] Dec. 12, 1978

[54] WINDOWS AND DOORS

[76] Inventor: Bernhard Kirsch, Im Litzelholz 23, 5500 Trier-Biewer, Fed. Rep. of Germany

[21] Appl. No.: 785,345

[22] Filed: Apr. 7, 1977

[30] Foreign Application Priority Data

Apr. 14, 1976 [DE] Fed. Rep. of Germany ..... 2616422
May 12, 1976 [DE] Fed. Rep. of Germany ..... 2621026
Jun. 21, 1976 [DE] Fed. Rep. of Germany ..... 2627727

[51] Int. Cl.[2] ..... E06B 7/28

[52] U.S. Cl. ..... 49/318; 49/320; 49/390

[58] Field of Search ..... 49/316–321; 160/89, 90, 91, 107

[56] References Cited

U.S. PATENT DOCUMENTS

| | | | |
|---|---|---|---|
| 355,904 | 1/1887 | Abrahamson | 160/107 X |
| 2,207,065 | 7/1940 | McCormick | 49/318 |
| 2,766,860 | 10/1956 | Travis | 49/318 |
| 2,805,451 | 9/1957 | Evans et al. | 49/318 |
| 3,252,255 | 5/1966 | Marpe | 49/318 |
| 3,562,954 | 2/1971 | Duguay | 49/318 |

*Primary Examiner*—Kenneth Downey
*Attorney, Agent, or Firm*—Robert W. Beach; Ward Brown

[57] ABSTRACT

This invention relates to closure systems of the kind comprising a closure member such as a window or door movable within a fixed frame consisting of two frame-like parts which have a gap between them and are connected together by connector members such as dowels or spacers, and comprising sealing and locking strips which are displaceably mounted in said gap in said fixed frame, said strips being guided by guide slots and guide connector members and each being insertable in a guide groove in the closure member. According to the invention, said strips contain said guide slots and said connector members are arranged to act as guide connector members to hold said parts at a distance from one another.

4 Claims, 30 Drawing Figures

Fig.14
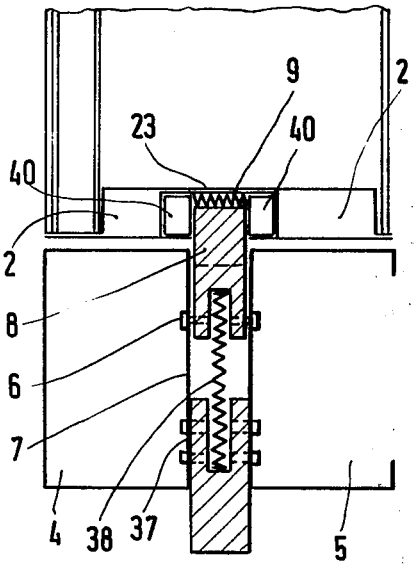
Fig.15
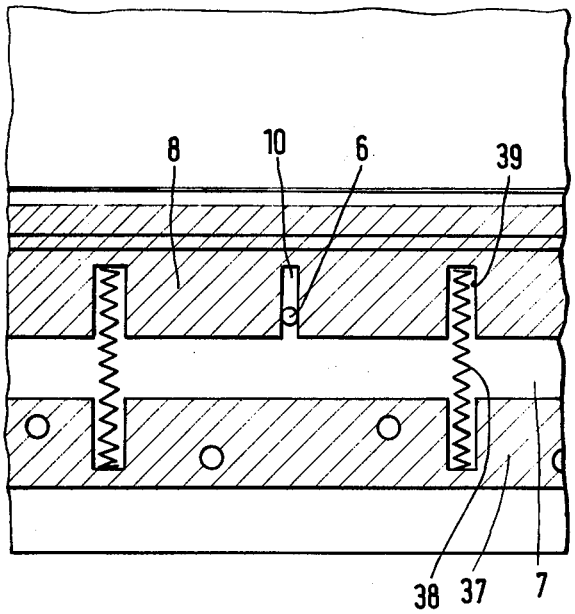
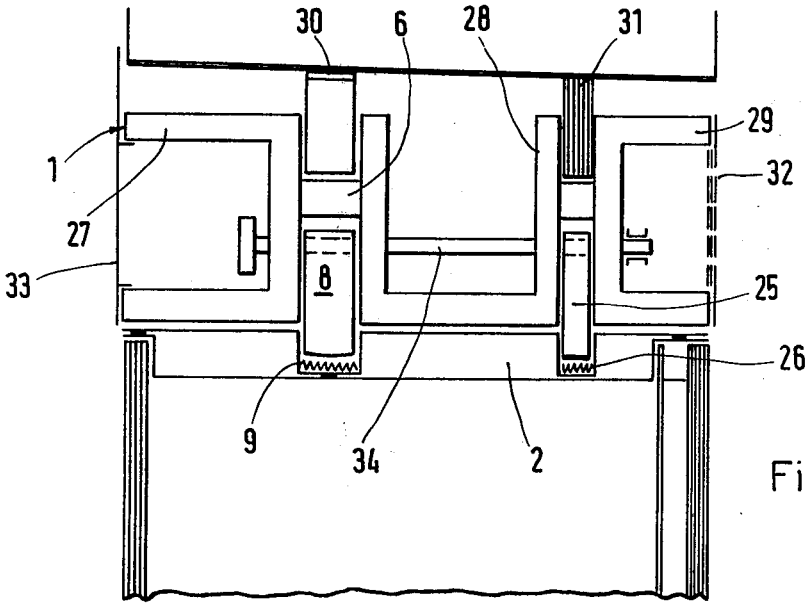
Fig.9

Fig.18
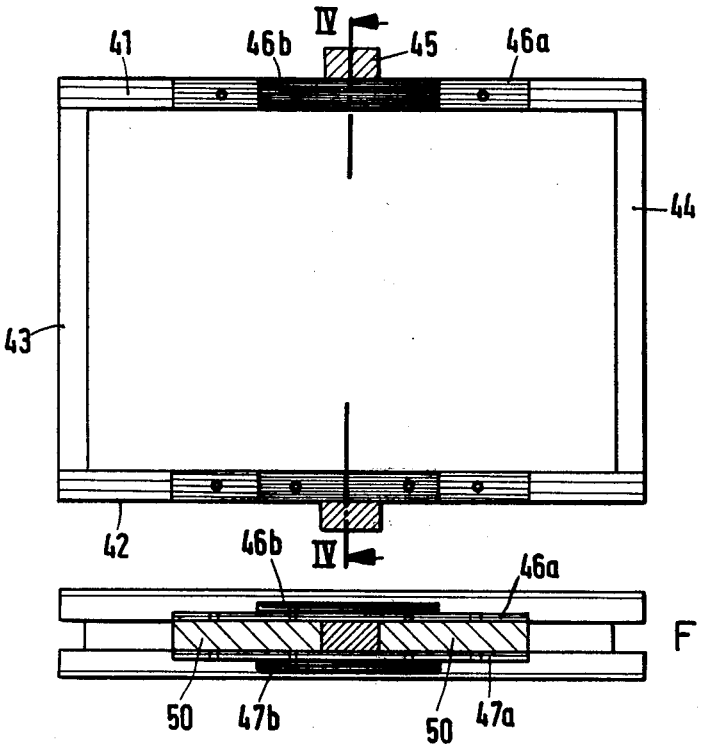
Fig.19
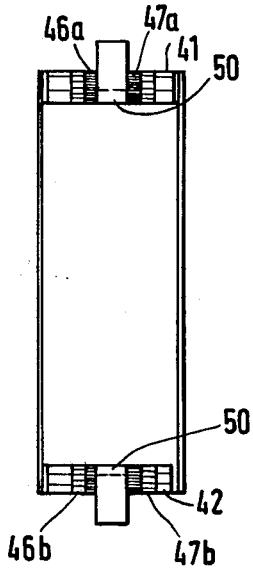
Fig.20
Fig.21
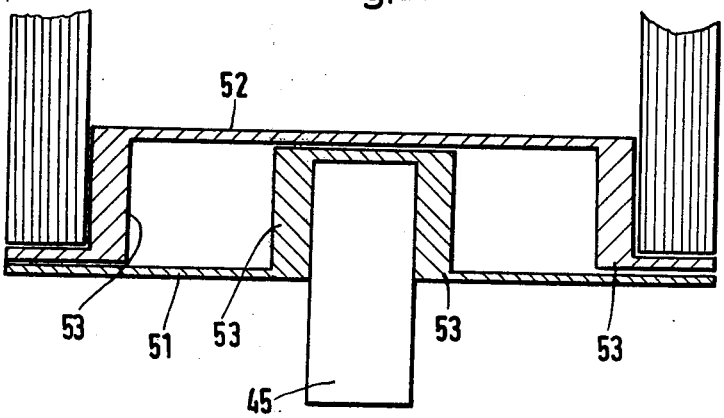

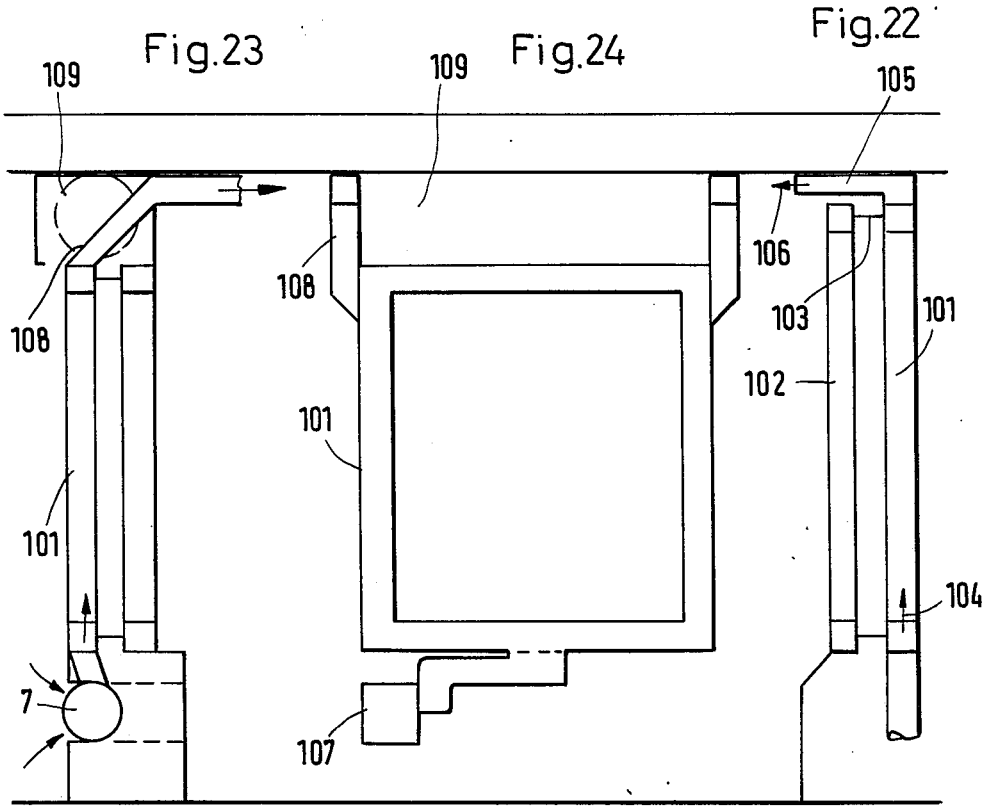
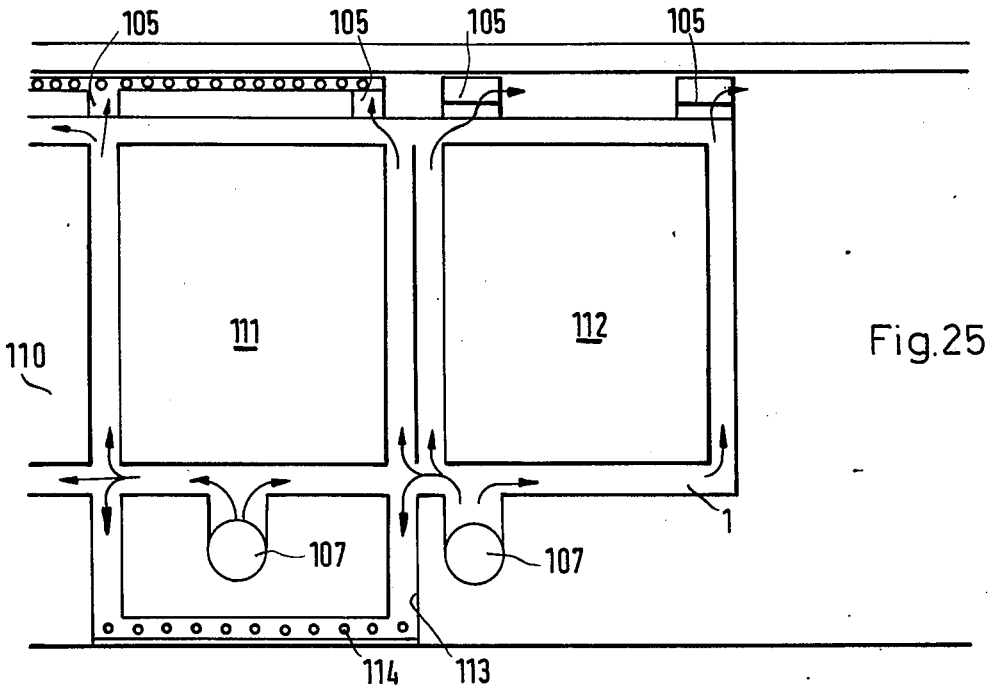
Fig.25

WINDOWS AND DOORS

BACKGROUND OF THE INVENTION

The present invention relates to windows or doors having a fixed frame consisting of two frame-like parts which have a gap between them and are connected together by dowels, and having sealing and locking strips which are displaceably mounted in the gap in the fixed frame, which strips are guided by guide slots and guide dowels and are each insertable in a groove in the window-sash or door.

In a known window of this kind, the fixed frame consists of two frame-like parts which are connected tightly together by screws near their outer edges and whose facing surfaces flex backwards in such a way that there is formed between them a gap which is open at one side. In this gap sealing and locking strips which are guided by special guide members are arranged to be displaceable. As a result, the construction of the known window is relatively complicated. In addition, the fact that the two frame-parts are secured at only one edge is a disadvantage, particularly because it means that it is precisely at the inside of the fixed frame, where it cooperates with the window-sash or door, that there is no hold.

By contrast, it is an object of the invention to provide a window or door of the kind described in which while the frame-parts are of simple design and easy to connect, the sealing and locking strips are properly guided and are steady and secure.

SUMMARY OF THE INVENTION

To achieve this and other objects, the window or door is characterized in accordance with the invention in that the strips contain the guide slots and the dowels are arranged to act as guide dowels and hold the parts at a distance from one another.

Advantageously, at least one of the frame-like parts is in the form of a hollow member of U-section which is open on the side remote from the strips, the member having a cover to close off the cavity in the U-section and the cavity having the actuating means for the strips arranged in it.

In a refinement, elongated holes extending perpendicularly to the guide-slots are arranged in the strips, and pins, cams or the like arranged on actuators project through these holes.

In a refinement, strips associated with adjoining sashes or doors are arranged in the gap between the two frame-like parts, these strips being displaceable in opposite directions. It is also possible to arrange distance pieces and/or seals, which project from the fixed frame on the side remote from the sash or door, in the gap between the two frame-like parts.

In a further advantageous embodiment, abutments against which a spring connected to the strip bears, are arranged in the gap between the two frame-like parts at a distance from the side.

BRIEF DESCRIPTION OF THE DRAWINGS

The invention is illustrated in the accompanying drawings which show some embodiments thereof by way of example as applied to windows and in which:

FIG. 9 is a sectional view of a fifth embodiment of fixed frame and sash, FIG. 14 shows a spring-mounted sealing and locking arrangement, FIG. 15 shows the arrangement of FIG. 14 rotated through 90°, FIG. 18 is a plan view of another embodiment of sash for a pivoting sash window, FIG. 19 is a section on IV—IV of the sash of FIG. 18, FIG. 20 is a side-view of the sash of FIG. 18, FIG. 21 shows a rail of a pivoting sash window made up of U-channels inserted into one another, FIG. 22 is a longitudinal section through a window, FIG. 23 is a cross-section through a window having a roller blind and built-in air-blowers, FIG. 24 is a front-view of the window of FIG. 23, FIG. 25 shows a window-unit having arrangements for the entry and exit of ventilating air.

DETAILED DESCRIPTION OF PREFERRED EMBODIMENTS

Figure 1:
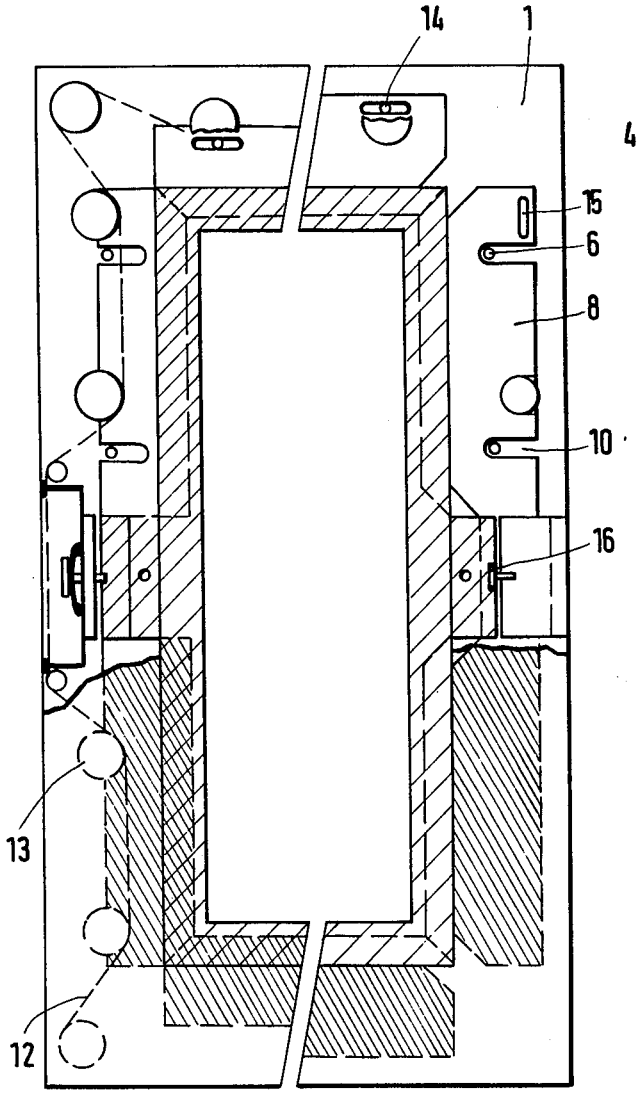
FIG. 1 is a plan view of a first embodiment of window having a fixed frame and a sash with parts broken away.
Figure 2:
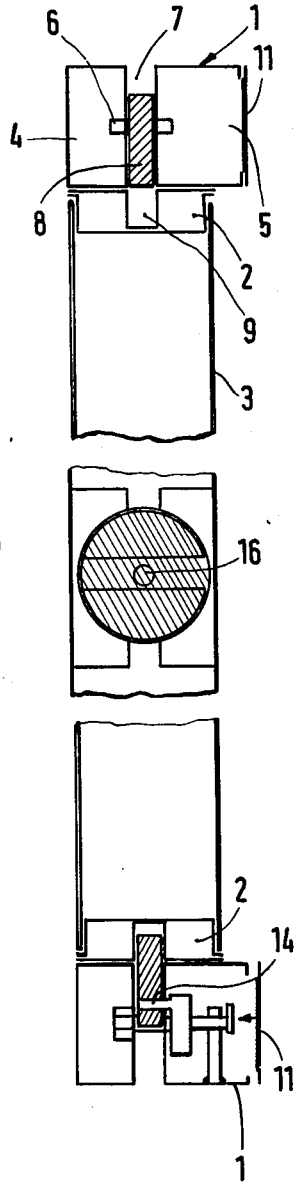
FIG. 2 is a section through the window of FIG. 1.

Referring now to the drawings the window shown in FIGS. 1 and 2 has a fixed frame 1, and a sash 2 which is rotatably mounted in the fixed frame 1 to form a pivoting sash. The sash 2 supports the glazing 3, which is in the form of multiple panes.

In accordance with the invention, the fixed frame 1 consists of two frame-like parts, an outer frame part 4 and an inner frame part 5, which are firmly connected together by dowels or sparers 6 in such a way that a gap or slot 7 is formed between the two parts. A strip 8 is displaceably mounted in the gap 7 formed in each rail of the frame and this strip 8 can be inserted in a groove 9 allotted to it in the sash in order to lock the sash and the fixed frame together and to seal them. The unlocked position is shown at the top of FIG. 2 and the locked position at the bottom.

Each of the strips 8 contains guide-slots 10 extending in the direction of displacement which are open towards the outer edge of the strip and which engage with associated dowel 6. This arrangement means that when being moved forward into the sash the strips cannot go off course transversely to the direction of movement.

Part 4 of the fixed frame is in the form of a hollow member and can be used to circulate air. Inner frame part 5 of the fixed frame is in the form of a hollow member of U-section and forms a channel opening at the side of such frame part remote from the outer frame part 4 and remote from the strip 8. The open side of the U-section can be closed off by a cover 11. The actuating means for the strips 8 are arranged in this part of the frame. The actuating means consist of a plurality of disc cranks 13 which are connected together by an actuating chain 12 and whose pins 14 engage in respective elongated holes 15 associated with them in the strip, the elongated holes 15 extending perpendicularly to the guide slots 10.

At the edges where they make contact, the strips 8 are advantageously mitred so that when they have been moved forward into the sash they are supported against one another and form a closed frame. Also those edges of the strips which lie adjacent a pivot shaft 16 may be similarly bevelled, as shown on the right hand side of FIG. 1.

Figure 3:
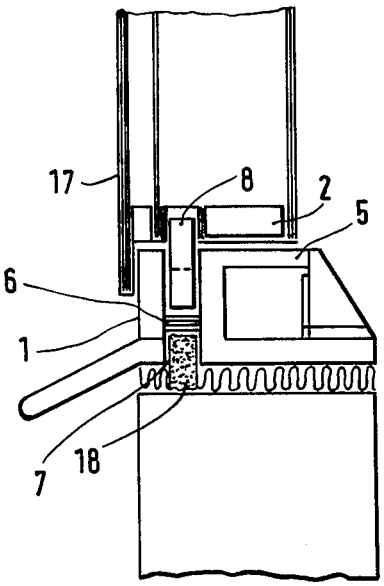
FIG. 3 is a sectional view of a second embodiment of fixed frame and sash.

In the embodiment of FIG. 3, the lower part of a fitted window is shown with a sealing and locking arrangement according to the invention. In this case the sash 2 carries sound insulating multiple glazing which is formed by three spaced panes of glass, with the outer pane 17 projecting from the sash 2 and resting against the fixed frame 1 when the window is closed. In this embodiment also the fixed frame has a part 5 in which the actuating means for the locking strip 8 are arranged. In the gap 7 which the dowels 6 form between the two parts of the frame, an additional distance and sealing piece 18 is arranged, which piece projects from the fixed frame on the side remote from the sash and can be cut to size when the fixed frame is being set in position in order to compensate for differences between the fixed frame and the opening in the wall.

Figure 4:
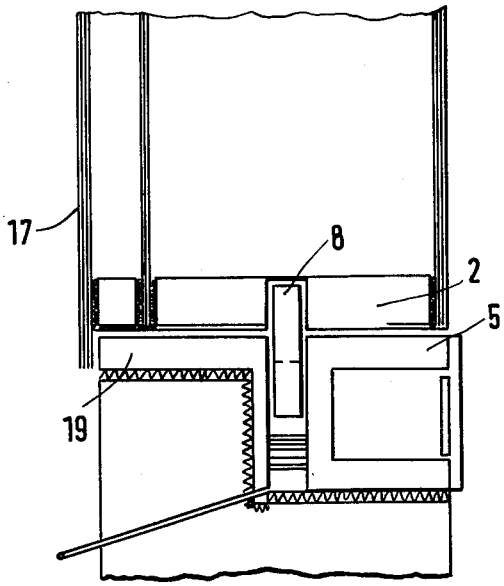
FIG. 4 is a sectional view of a third embodiment of fixed frame and sash

In the embodiment in FIG. 4, one 5 of the frame parts is once again in the form of a U-member while the other frame part 19 is in the form of an angle frame.

Figure 5:
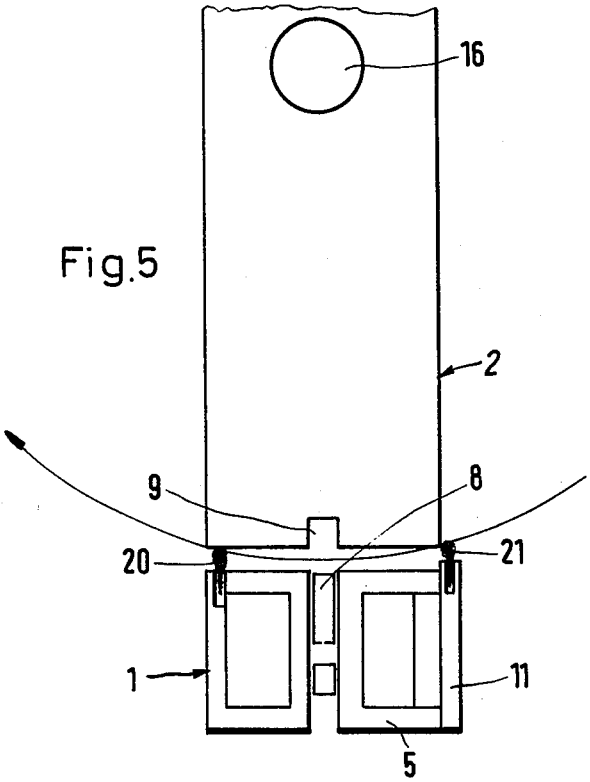
FIG. 5 is a sectional view of a fourth embodiment of fixed frame and sash, in the case of a pivoting-sash window.

In the embodiment shown in FIG. 5, which shows a pivoting-sash window, sealing fillets 20 and 21 are provided at both edges between the sash 2 and the frame 1.

Figure 6:
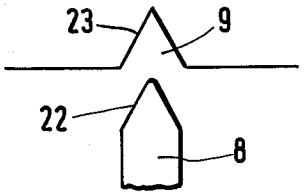
FIGS. 6 to 8, show various embodiments of displaceable strip and the grooves in the sash associated with them.
Figure 7:
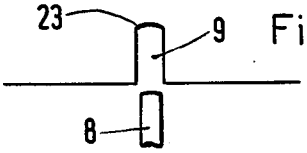
Figure 8:
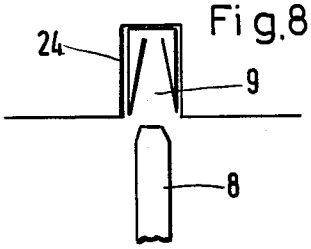

FIGS. 6 to 8 show various embodiments of the strip 8 and of the groove 9 associated with it in the sash. In FIG. 6, the outer edge 22 of the strip is of a pointed roof-like shape while in FIG. 7 it is outwardly cambered. It is advantageous for a seal 23 to be provided in the groove 9.

In FIG. 8, there is in the groove 9 a resilient insert 24 which provides more resilient and easier guidance for the strip 8 as it enters the groove 9 in the sash 2.

In the embodiment of FIG. 9, two locking strips 8 and 25 are arranged parallel to one another and engage in corresponding grooves 9 and 26 in a sash 2 carrying multiple glazing. In this case the fixed frame 1 consists of three parts 27, 28 and 29 and there are once again connected together by dowels 6 in such a way that gaps are left between the individual parts in which the strips 8 and 25 are displaceable and into which a compensating piece 30 and a resilient seal 31 project on the side remote from the sash 2. Part 29 of the fixed frame 1 is in the form of a hollow channel containing air outlet openings 32 and is used for ventilation. Part 27 of the fixed frame 1, which is U-shaped and is closed off by a cover 33, contains the actuating arrangements for the strips 8 and 25, these being operated by means of a common actuating shaft 34.

Figure 10:
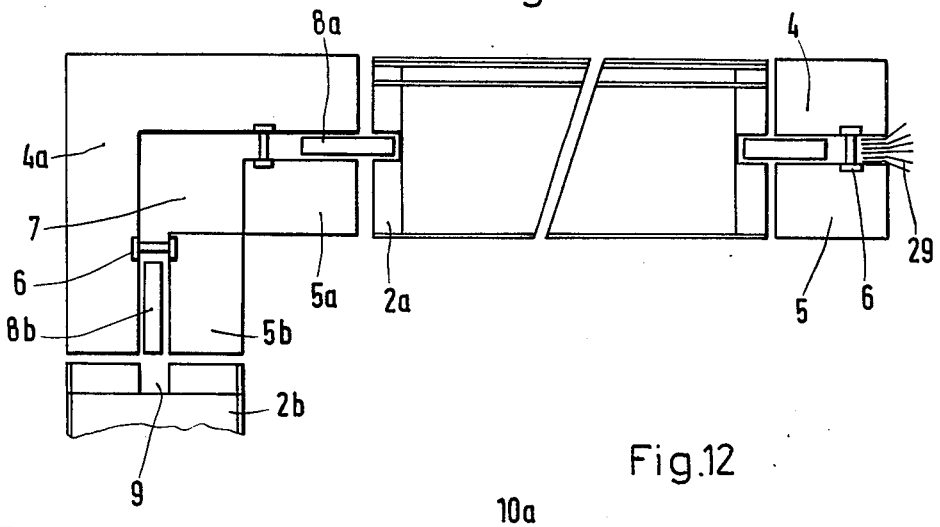
FIG. 10 shows sealing and locking means for two sashes, arranged in a common corner piece.

In FIG. 10, one of the parts of the fixed frame 1 is formed as a corner member **4*a* and two parts 5*a* and 5*b* arranged at an angle are connected to it by means of dowels 6. In the gap 7 between parts 4*a* and 5*a*, and 5*a* and 5*b*, strips 8 which can be inserted in associated grooves 9 in the appropriate sash 2** are displaceably mounted.

Figure 11:
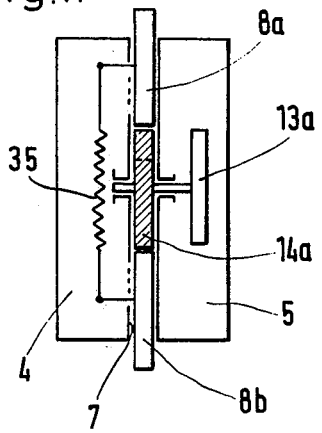
FIG. 11 shows another embodiment of sealing and locking means which act in two directions.
Figure 12:
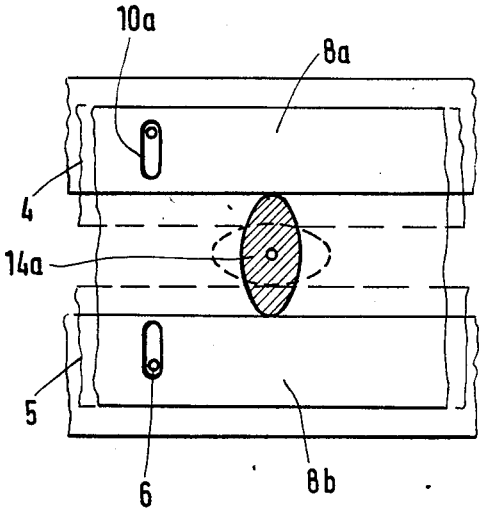
FIG. 12 shows the arrangement of FIG. 11 rotated through 90°.

In the embodiment shown in FIGS. 11 and 12, two strips **8*a* and 8*b* which can be displaced in opposite directions are arranged in the gap 7 between parts 4 and 5 and these strips can be displaced outwards by a cam 14*a* connected to an actuator 13*a* and are connected together by a return spring 35. During their displacement, the strips are guided by elongated holes 10*a* which fit over the spacers 6**.

Figure 13:
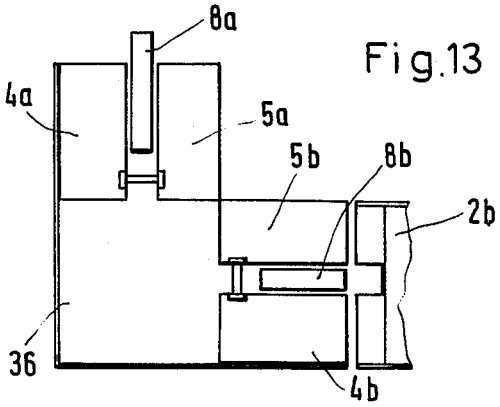
FIG. 13 shows a further embodiment of means acting at an angle in two directions.

The embodiment in FIG. 13 differs from that in FIG. 10 in that the outer parts **4*a* and 4*b* are held together by an angled connector 36**.

In FIGS. 14 and 15, an abutment 37 is mounted in the gap 7 at a distance from the strip 8 and bearing against it are springs 38 whose other ends project into recesses 39 in the strip, thus spring loading the strip into the inserted position. To enable the strips to slide more easily in the groove 9 in the sash 2, slide pieces 40 are arranged on either side of groove 9.

Figures 16, 17:
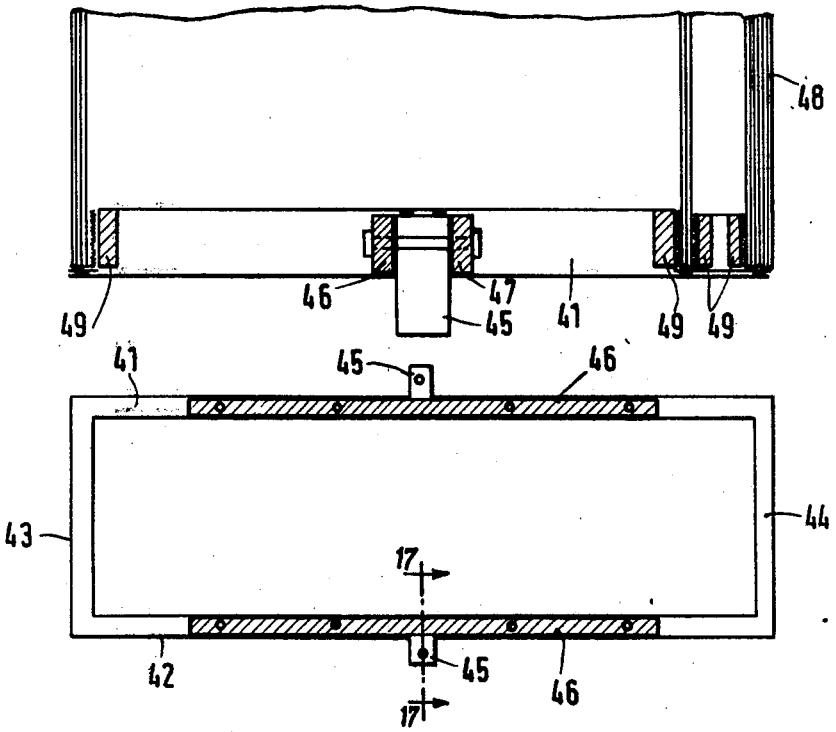
FIG. 16 shows a rail of a pivoting sash window provided with a tongue.
FIG. 17 is a section on II—II of a sash of the pivoting sash window of FIG. 16.

The sash shown in FIGS. 16 and 17 consists of rails 41 and 42 and of rails 43 and 44 extending perpendicularly thereto. The rails 41 and 42 carry tongues 45 which hold the pivot shafts of the sash. The rails 41 and 42 are reinforced on either side of the tongues 45 by strips of sheet-metal 46 and 47. By means of this reinforcement the loads acting on the tongues 45 are spread to the rails 41 and 42 of the frame. Also, reinforcing strips 49 are arranged in rails 41 and 42 parallel to and at a distance from the reinforcing strips 46 and 47 arranged on either side of the tongues 46. By this means it is possible for the rails 43 and 44 to be relatively weak. In the embodiment of FIGS. 16 and 17 the frame rails carry multiple glazing 48.

In the embodiment shown in FIGS. 18 to 20, the rails 41 and 42 are once again reinforced by load-spreading strips **46*a* and 46*b* on one side and 47*a* and 47*b* on the other. In this embodiment the strips 46*a* and 47*a* are longer than the adjacent strips 46*b* and 47*b* which are connected to them and lie on top of them. In addition, reinforcing strips 50 lying transversely to the plane of the glazing are arranged in rails 41 and 42**.

In the embodiment of FIG. 21, the rails carrying the tongues 45 are formed from two U-channels 51 and 52 which are fitted into one another with their mutually parallel sides 53 acting as strengthening.

In this embodiment also, the rails 43 and 44 extending perpendicularly to the rails 41 and 42 may be of very light construction since they perform no load-bearing function.

The window in FIG. 22 has an outer frame part 101 and an inner frame part 102 at a distance therefrom. The two frame parts are held together by spacers 103 which form point connections between the frame parts 101 and 102 at a small number of places and which may consist of a plastics material or the like which is a poor conductor of heat. Each frame part 101 and 102 may have single or multiple glazing.

The outer frame part 101 is formed as a hollow body, so that, as indicated by arrow 104, air from outside can flow upwards or vice versa inside the rails of part 101. At the upper end of the outer frame part 101 there are arranged, in accordance with the invention, one or more air circulation ducts 105 which project above the inner frame part 102 into the interior of a room or similar enclosure so that air can emerge from their ends, as indicated by arrow 106.

In the embodiment of FIGS. 23 and 24, air is drawn in from the external atmosphere by a blower 107 and is pumped upwards through the cavity in the outer frame part 101. At the upper end of the outer frame part 101 are situated air circulation ducts 108, which extend past the sides of a casing 109 for a roller blind which is arranged above the window, and across the ceiling of the room into its interior.

In the embodiment of FIG. 25, a plurality of windows 110, 111 and 112 is combined to form a window unit, with the outer frame parts once again being formed as hollow bodies. In this case too, air is pumped into the interior of the outer frame parts 101 by blowers 107 and it then flows upwards to emerge into the interior above the inner frame parts via air circulation ducts 105. In addition, a proportion of the stream of air flows through an air inlet duct 113 arranged underneath window 111 and from this duct air can reach the interior along the skirting through air outlet openings 114. Depending upon the setting of the blower, it is of course also possible to cause the flow of air to take place in the opposite direction so that air is pumped out of the room or the like into the surrounding atmosphere.

Figure 26:
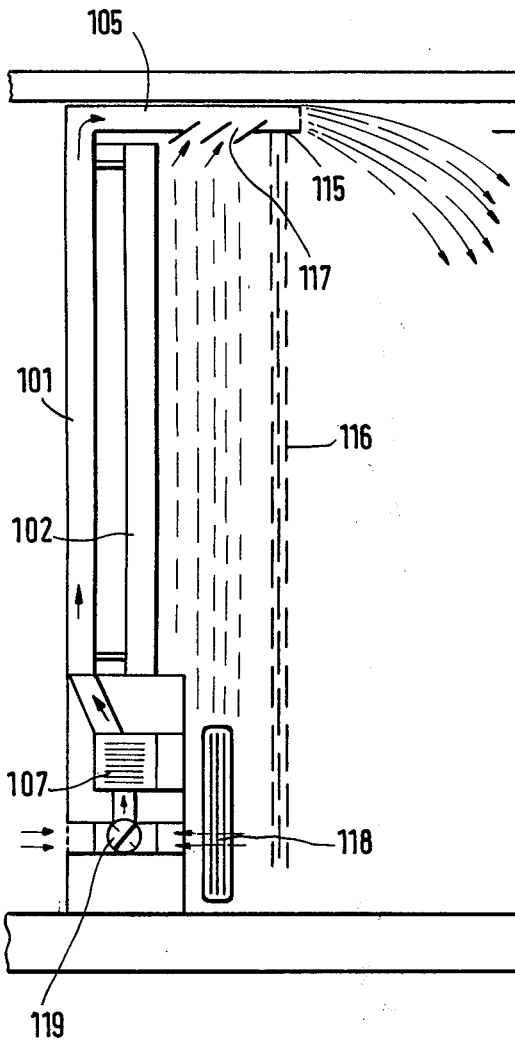
FIG. 26 is a cross-section of another embodidiment of window.
Figure 27:
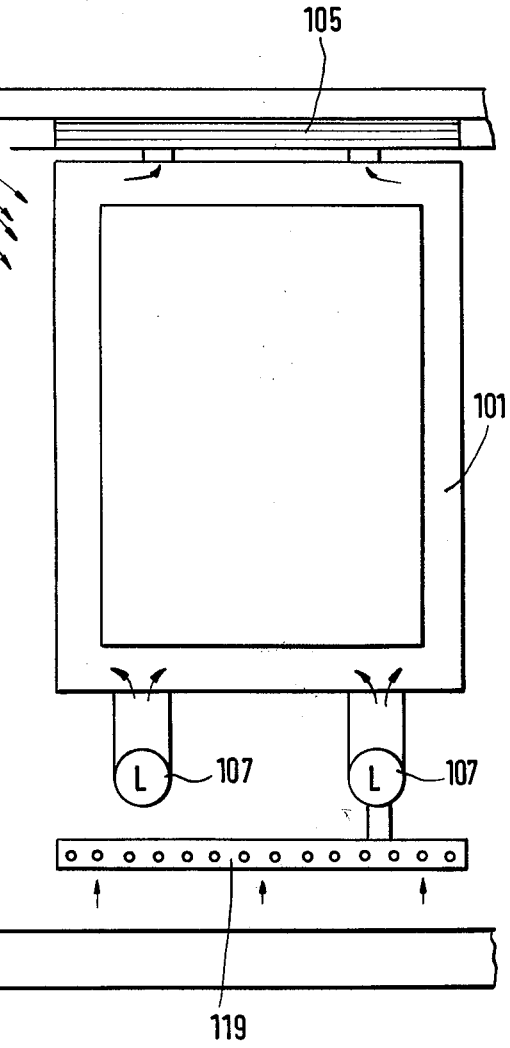
FIG. 27 is a front view of the window of FIG. 26.

In the case of the embodiment shown in FIGS. 26 and 27, there is once again provided an outer frame part 111 with an air circulation cavity and an air circulation duct 105, the outer frame part 111 being arranged at a distance from the inner frame part 102. Underneath the window is situated a blower 107 which draws in outside air and feeds it into the interior via the outer frame part 101 and the air circulation duct 105. Underneath the air circulation duct 105 is provided a support 115 for a curtain 106. Also arranged in the underside of the air circulation duct 105, between the inner frame part 102 and the curtain support 115, are air inlet openings 117 through which air rising from a radiator 118 for example can make its way into the air circulation duct 105. The flow of air which is being fed through the outer frame part 101 into the air circulation duct 105 carries this warm air with it and expells it at an accelerated rate.

Underneath the blower 107 is provided a changeover device 119 which enables either external air or warm air coming directly from the radiator 118 to be fed to the blower 107, as selected. In this way it is possible to feed only warm air into the room for heating purposes or else to feed in a mixture of fresh air and warm air from inside.

Figure 28:
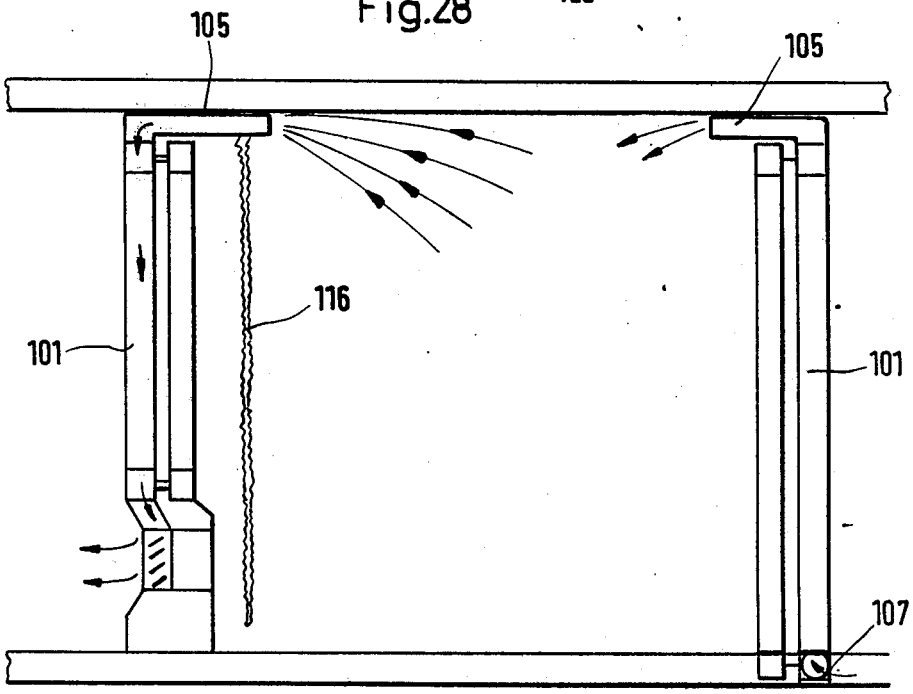
FIG. 28 shows an arrangement for ventilating an enclosure fitted with a window according to the invention.

The embodiment shown in FIG. 28 can be used simultanenously to introduce air into an enclosure and extract it therefrom. In this case fresh air is introduced into the interior of an enclosure by a blower 107 through the outer frame part 101, of a door for example, and through air circulation ducts 105. For extraction, the used air flows over the top of the curtain 116 through the air circulation duct 105 and downwards through the air circulation cavity in the outer frame part 101 and from there into the surrounding atmosphere.

Figure 29:
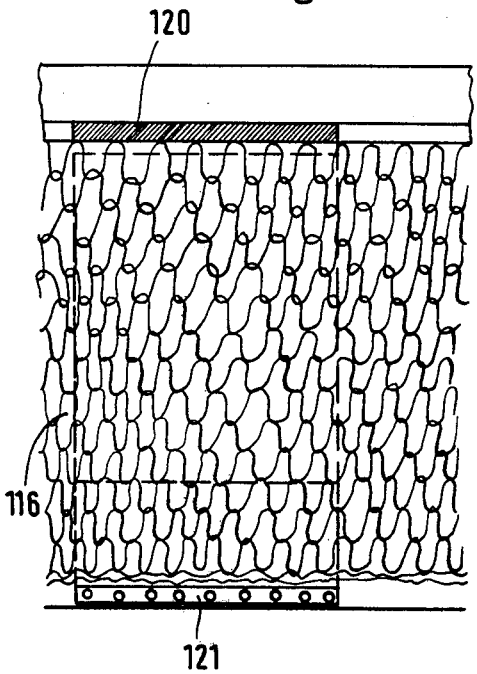
FIG. 29 is a front view of a curtained window.
Figure 30:
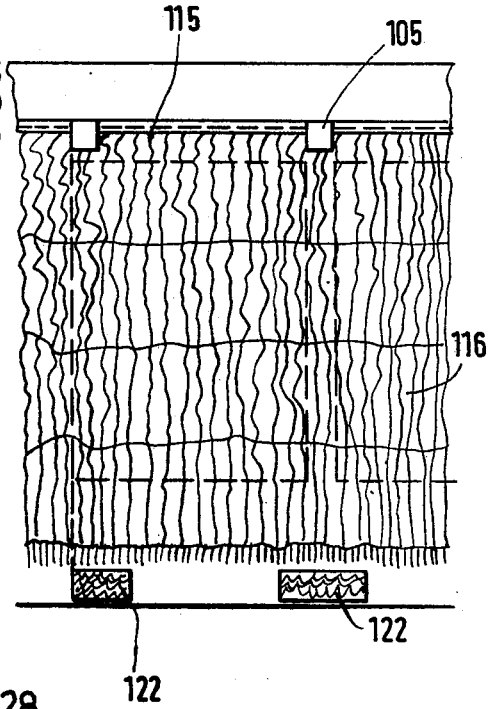
FIG. 30 is a front view of another embodiment of window with a curtain.

FIGS. 29 and 30 show embodiments with curtains hung in front of them. In FIG., 29 air emerges into the interior of the room above the curtain through a wide outlet 120 which is closed off by a grille and there is a further air outlet underneath the curtain in a skirting panel 121. In the embodiment shown in FIG. 30, the openings of a plurality of air circulation ducts 105 can be seen spaced above the curtain support 115, while below the curtain a plurality of spaced air outlet openings 22 are provided above the floor.

I claim:

1. In a closure system including:

a frame including an outer frame part and an inner frame part located inward from the outer frame part, such frame parts forming the sides of a strip-receiving slot therebetween;

connector means connecting the frame parts;

a closure member mounted in the frame for movement relative thereto between closed and open positions, such closure member having a peripheral guide groove opening toward the strip-receiving slot between the frame parts when the closure member is in closed position;

an elongated sealing and locking strip mounted in the strip-receiving slot for movement relative to the frame transversely of the length of such strip; and means for moving the sealing and locking strip relative to the frame outward of the slot and toward the closure member for engagement of such strip in the peripheral guide groove of the closure member;

the improvement comprising:

the inner frame part being of U-shaped cross section and forming a channel opening at the side of the inner frame part remote from the outer frame part and remote from the sealing and locking strip;

the moving means being located in said channel; and a removable cover for closing the channel opening to enclose the moving means in said channel.

2. In the closure system defined in claim 1, the improvement further comprising the sealing and locking strip including elongated guide slots each having its length extending transversely of the length of such strip, and the connector means including a plurality of connector dowels extending across the slot through such guide slots for guiding movement of such strip relative to the frame.

3. In the closure system defined in claim 1, the improvement further comprising the sealing and locking strip having elongated holes extending longitudinally of such strip, and the actuating means including pins received in said holes and means for swinging said pins to move the strip relative to the frame.

4. In a closure system including:

a frame having a strip-receiving slot opening at the inner periphery of the frame;

a closure member mounted in the frame for movement relative thereto between closed and open positions, the closure member having a peripheral guide groove opening toward the strip-receiving slot when the closure member is in closed position;

an elongated sealing and locking strip mounted in the strip-receiving slot for movement relative to the frame transversely of the length of such strip; and means for moving the sealing and locking strip relative to the frame toward the closure member for engagement of such strip in the peripheral guide groove of the closure member;

the improvement comprising:

spacer and guide pegs each connecting the sides of the strip-receiving slot;

the sealing and locking strip having elongated guide slots each extending transversely of the length of such strip and receiving one of the spacer and guide pegs for guiding movement of such strip relative to the frame, such strip further having elongated holes extending generally perpendicular to the guide slots and longitudinally of such strip; and the moving means including rotatable disc cranks each having a pin offset from the axis of rotation of its disc crank and received in one of the elongated holes of the sealing and locking strip and means for rotating said disc cranks to swing said pins and move the sealing and locking strip transversely of its length.

* * * * *